US011679522B2

(12) United States Patent
Lee

(10) Patent No.: US 11,679,522 B2
(45) **Date of Patent: *Jun. 20, 2023**

(54) CUTTING APPARATUS FOR HAIR OR FIBER AND A CUTTING DEVICE USING SAME

(71) Applicant: Lee Innovations, LLC, Chesapeake City, MD (US)

(72) Inventor: Ross A Lee, Chesapeake City, MD (US)

(73) Assignee: Lee Innovations, LLC, Chesapeake City, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/865,812

(22) Filed: Jul. 15, 2022

(65) Prior Publication Data

US 2022/0347872 A1 Nov. 3, 2022

Related U.S. Application Data

(63) Continuation of application No. 16/686,972, filed on Nov. 18, 2019, now Pat. No. 11,389,979, which is a (Continued)

(51) Int. Cl.
*B26B 21/34* (2006.01)
*B26B 19/14* (2006.01)

(Continued)

(52) U.S. Cl.
CPC ..... *B26B 21/34* (2013.01); *B26B 19/148* (2013.01); *B26B 21/4006* (2013.01);

(Continued)

(58) Field of Classification Search
CPC ..... B26B 21/446; B26B 21/4081; B26B 21/4006; B26B 21/34; B26B 19/148; B26D 1/36

See application file for complete search history.

(56) References Cited

U.S. PATENT DOCUMENTS 448,482 A 3/1891 Ginter
875,960 A 1/1908 Smith (Continued)

FOREIGN PATENT DOCUMENTS

DE 19715900 10/1998
DE 102010035884 4/2011

(Continued)

OTHER PUBLICATIONS

Picture and Description of Product from Badger and Blade Website: http://badgerandblade.com/vb/showthread.php/56762-The-Rolling-Razor-Rolling-Into-Trash-Cans-Near-You! Printed May 8, 2014 (9 Pages).

(Continued)

*Primary Examiner* — Jennifer S Matthews
(74) *Attorney, Agent, or Firm* — Volpe Koenig

(57) ABSTRACT

A cutting apparatus for hair or fiber protruding from a surface includes a roller, a number of cutting features disposed at an outer peripheral surface of the roller, wherein the number of cutting features is adapted for cutting the hair or fiber when the roller rotates in contact with the filamentous surface or is moved while in contact with the filamentous surface.

16 Claims, 6 Drawing Sheets

Related U.S. Application Data continuation of application No. 14/273,259, filed on May 8, 2014, now Pat. No. 10,478,982.

(60) Provisional application No. 61/821,193, filed on May 8, 2013.

(51) Int. Cl.
*B26B 21/40* (2006.01)
*B26D 1/36* (2006.01)
*B26D 1/00* (2006.01)

(52) U.S. Cl.
CPC ..... *B26B 21/4081* (2013.01); *B26D 1/36* (2013.01); *B26D 2001/002* (2013.01); *Y10T 83/9372* (2015.04)

(56) References Cited

U.S. PATENT DOCUMENTS

| | | | | | |
|---|---|---|---|---|---|
| 978,705 | A | | 12/1910 | Dannacher | |
| 1,382,677 | A | | 6/1921 | Schmitz | |
| 1,440,631 | A | | 1/1923 | Schlichter | |
| 1,855,663 | A | | 4/1932 | Bregman | |
| 2,040,599 | A | | 5/1936 | Davies | |
| 2,127,881 | A | * | 8/1938 | Morris | B26B 21/24 30/40 |
| 2,342,291 | A | | 2/1944 | Morelli | |
| 2,382,296 | A | * | 8/1945 | Crowell | B26B 21/00 30/294 |
| 2,565,062 | A | * | 8/1951 | Blanchard | B26B 21/24 30/40 |
| 2,697,874 | A | | 12/1954 | Tomchek | |
| 3,137,940 | A | * | 6/1964 | Curci | B26B 21/24 30/40 |
| 3,299,507 | A | | 1/1967 | Mistretta | |
| 3,430,341 | A | | 3/1969 | Choate | |
| 3,722,091 | A | | 3/1973 | Gagnon | |
| 3,802,072 | A | | 4/1974 | Wintercorn | |
| 4,103,418 | A | | 8/1978 | Alvarez | |
| 4,430,794 | A | * | 2/1984 | Miller | B26B 19/148 30/29.5 |
| 4,807,360 | A | * | 2/1989 | Cerier | B26B 21/20 30/41 |
| 4,916,814 | A | | 4/1990 | Althaus | |
| 4,979,298 | A | | 12/1990 | Pesiri | |
| 5,802,720 | A | * | 9/1998 | Pribe | B26B 21/00 30/32 |
| 6,272,752 | B1 | * | 8/2001 | Pino | B26B 19/16 30/29.5 |
| 6,493,950 | B1 | | 12/2002 | Kludjian et al. | |
| 8,105,340 | B2 | | 1/2012 | Grieshaber et al. | |
| 2006/0218793 | A1 | | 10/2006 | Zucker | |
| 2011/0016722 | A1 | * | 1/2011 | Stark | B26B 19/00 30/45 |
| 2011/0138637 | A1 | * | 6/2011 | Bucco | B26B 21/521 30/527 |
| 2012/0078269 | A1 | | 3/2012 | Grieshaber et al. | |
| 2012/0192432 | A1 | * | 8/2012 | Zane | B26B 21/28 30/346.5 |
| 2013/0333219 | A1 | | 12/2013 | Oxford et al. | |
| 2014/0123497 | A1 | * | 5/2014 | Zhuk | B26B 21/565 76/104.1 |

FOREIGN PATENT DOCUMENTS

| | | | | | |
|---|---|---|---|---|---|
| DE | 102010035884 | A1 | * | 4/2011 | B26B 21/20 |
| EP | 0273992 | | | 7/1988 | |
| EP | 0389007 | | | 9/1990 | |
| EP | 2428338 | | | 3/2012 | |
| EP | 2428338 | A1 | * | 3/2012 | B26B 21/00 |
| FR | 1015370 | | | 9/1952 | |
| FR | 1037709 | | | 9/1953 | |
| GB | 966371 | | | 8/1964 | |
| WO | 99/06190 | | | 2/1999 | |
| WO | WO-2006072851 | A1 | * | 7/2006 | B26B 19/00 |

OTHER PUBLICATIONS

Picture and Description of Product from Lollypup Website: http://lollypup.com.sg/new-arrivals/beauty-roller-for-grabbing-pet-hair.html Printed May 8, 2014 (1 Page).

Picture and Description of Product from Verseo Website: http://www.verseo.com/verseo-esmooth-hair-removal-epilation-roller-pen.html Printed May 8, 2014 (7 Pages).

Picture and Description of Product from My Bellabe Website: http://mybellable.com/ Printed May 8, 2014 (2 Pages).

* cited by examiner

CUTTING APPARATUS FOR HAIR OR FIBER AND A CUTTING DEVICE USING SAME

CROSS REFERENCE TO RELATED APPLICATION(S)

This application claims the benefit of U.S. Pat. No. 11,389,979 with a issue date of Jul. 19, 2022, which is a continuation of U.S. Pat. No. 10,478,982 with an issue date of Nov. 19, 2019, which claims the benefit of U.S. provisional application 61/821,193 with a filing date of May 8, 2013 which is incorporated by reference as if fully set forth.

FIELD OF INVENTION

The invention generally relates to a cutting apparatus for hair or fiber. More specifically, embodiments of the invention relate to an apparatus having a compliant cutting surface for cutting surface hair or fiber from a non-rigid, irregularly shaped or smooth, hair- or fiber-bearing surface.

BACKGROUND

Typical cutting surfaces on cutting devices are primarily rigid edges such as those found on knives and razors. This makes it difficult and unsafe to use them for cutting near or on irregularly shaped or compliant or flexible substrates or surfaces. For example typical razors do not easily conform to natural shape variations, curvatures, folds, etc. In addition there is great difficulty in removing or cutting hair from narrow or tightly constrained surfaces and crevices such as the ears and nose. Other areas where current cutters are problematic are in pet hair trimming, body hair removal in general, and any other areas where protruding fibers, strands, or other protrusions need to be cut from a flexible, conformable or non-rigid, or smooth surface.

One attempt to address this need has been flexible or pivot head razors. These do not allow the cutting surface of the cutter to be compliant with flexible or convoluted hair- or fiber-bearing surfaces on which the blade is being used. Consequently flexible or pivot-head razors have not adequately addressed the need for effective cutting of hair or fiber on non-rigid, irregularly shaped or smooth surfaces such as those found on the face and other regions of the body and in tightly constrained areas and crevices.

Another attempt to address this has been in electric cutting devices, such as electric razors with rotating blades. Here, again, the actual cutting blade is rigid and the device relies on pivot heads to get the spinning rigid blades to conform to a non-rigid, irregularly shaped or smooth surface such as a face or other body surface. The performance of such electric razors leaves much to be desired especially where the area for hair or fiber to be cut from has convolutions, crevices or an irregular shape or surface.

Still another attempt to address this has been in systems that provide a material or process to actually remove, rather than cut the protruding fiber or hair. These systems are typically specific for protein fibers such as hair, and contain noxious chemicals, such as thioglycolates, to promote digestion of the protein and, require considerable time and temperature, and are typically quite expensive.

Accordingly, a need exists for a compliant cutting surface for cutting surface hair or fiber from a non-rigid, irregularly shaped or smooth, hair- or fiber-bearing surface.

SUMMARY

"Filamentous" as used herein refers to threadlike structures, i.e., resembling a filament, of natural or synthetic materials and may include, as non-limiting examples, hair or fibers. "Filamentous surface" and "hair- or fiber-bearing surface" are used interchangeably herein to refer to a surface from which filamentous structures, e.g., hairs or fibers, project or protrude at an angle to the surface.

A "compliant surface" as used herein refers to surface that yields under an applied force to at least partially conform in shape to a contacting surface. The force may be manually generated and applied with or without mechanical intervention, or may be machine generated and applied.

One aspect of the present invention is directed towards a cutting apparatus having a surface that is compliant and can be conveniently squeezed and/or rolled or otherwise comfortably contacted with the hair- or fiber-bearing surface that is being trimmed of the protruding fiber or hair. In so doing, the fiber or hair will be effectively cut regardless of the shape of the folds or irregularities since the cutting surface of the cutting device itself will conform to, and/or easily follow the path of, the irregular, compliant, flexible or constrained area of the hair- or fiber-bearing surface. The compliant cutter and compliant cutting surface can be in any form that enables conformable engagement with the hair- or fiber-bearing surface to effect cutting and removal, including but not limited to compliant fabrics, bundles, spheres, rollers (rigid and conformable), that can be moved, rubbed, squeezed or rolled over an irregular surface with folds, convolutions, crevices, orifices, etc.

In an embodiment, the present cutting apparatus comprises a roller having a plurality of cutting elements or features disposed on an outside peripheral surface of the roller. All, or at least some, of the plurality of cutting features are adapted for cutting filamentous protrusions disposed on or growing from a filamentous surface when the roller rotates in contact with the filamentous surface.

Another aspect of the present invention is directed towards a cutting device having a compliant cutting surface in the shape of a spherical or cylindrical roller and is fitted with a suitably affixed handle to enable the cutting device to roll along the contours, folds and irregular shape of the hair- or fiber-bearing surface. The dimensions of the sphere or roller can be modified in non-limiting examples to fit narrow openings, such as human ears and nostrils, for hair removal or can be wider and larger for larger areas of the body or other compliant hair- or fiber-bearing surface such as the back, chest, midriff or other larger area. The aforementioned handle can be affixed to the spherical or cylindrical roller in any means effective to enable rolling of the cutting surface over the hair- or fiber-bearing surface to facilitate cutting of the hair or fiber. For example, in an embodiment a cylindrical roller is supported for rotation about a longitudinal axis (like a paint roller).

An embodiment of the present invention is directed to a cutting device comprising a support member and a cutting apparatus comprising a roller having a plurality of cutting elements or features disposed on an outside peripheral surface of the roller. All, or at least some, of the plurality of cutting features are adapted for cutting filamentous protrusions disposed on or growing from a filamentous surface when the roller rotates in contact with the filamentous surface. The support member supports the cutting apparatus for rotation with respect to the support member.

In another embodiment a spherical roller may be partially enclosed in a tube and free to rotate about a changing axis of rotation (like a ball point pen). In this configuration the tube bearing the compliant or rigid roll able sphere can contain fluids or other material forms (e.g. solids, vapors (e.g. steam)) to enhance the severing of the hair or fiber by the rolling sphere. In this configuration, as well, the tube can act as a reservoir to remove the severed hair or fiber that can then be removed and disposed of, recycled or reused. The tubes can be interchangeable to enable a primary (before cutting) or secondary (post cutting) treatment to be applied to the surface to enhance the cutting and/or enhance the cut surface. The removed material can be taken up and treated in the tube reservoir to be disposed of, emptied, cleaned, reused and/or recycled.

Another aspect of the present invention is directed towards a cutting surface on a spherical or cylindrical roller wherein the surface is not soft or compliant but is effective in rolling along the contours of the hair- or fiber-bearing surface to be cut. Such a cutting surface will be described herein as being "rigid." The affixed handle can be as described above and in the configuration comprising a tube can provide all the benefits and features described above.

In another aspect of the present invention, the present invention is directed towards a cutting surface that is comprised of a bundle of one or more sharp edged ribbons, wires, threads, or biomass elements, such as leaves, grasses or hair, or other fiber being cut itself. These can be homogeneous or can be composites of materials or can be a cutting surface on the ribbon, wire, thread or biomass of a different or the same but modified shape or composition. These can either make up the conformable shape, spherical or cylindrical rollers described above, or form the outer shell of a structure that has a core made of another material to provide shape, conformability or other advantageous features, including cost savings.

Another aspect of the present invention is directed towards a cutting surface that is comprised of cutters such as conventional razors or other very sharp, cutting edged metal, or other materials, embedded in or disposed on the outermost surface of the shape, sphere or roller so that the cutting edge forms an effective cutting surface for the conformable or rigid shape, spherical or cylindrical roller and effects the hair or fiber removal when contacted with the conformable or irregular hair- or fiber-bearing surface. A means may be provided to enable turning of the sphere or roller indirectly from or independent of the contact with the conformable hair- or fiber-bearing surface and/or in cutting contact with a cutting bar or edge to enable more effective cutting and/or variable height of the cut. The dimensions of the individual embedded cutters can be sized to be the same; multiple sizes and/or any combinations including exceeding small but effective individual cutters.

In another aspect of the present invention, the invention is directed towards a cutting surface that is comprised of cutting apertures, slits, grooves, or other designs in the outermost surface of the cutting shape, spherical or cylindrical roller. In a compliant spherical or cylindrical roller these may open to engage and trap the fiber or hair and then as pressure is released or the roller moved, the aperture, slit, groove or other design closes or otherwise changes to effect and/or enable severing of the fiber or hair.

In another aspect of the present invention, the invention is directed towards a cutting surface comprised of any of those mentioned above but that advantageously includes the application of solutions, enzymes or other materials or effects, including heat and/or steam or other energy, to promote the fiber or hair removal. The solutions may be either externally applied or released from, or an effect of, the cutting device itself as for example via a reservoir in the core or bulk of the conformable or rigidly shaped, spherical or cylindrical roller or other means to produce a beneficial effect during the cutting operation. In a non-limiting embodiment, a portion of the cutting surface becomes tacky and helps pull the fiber or hair toward the cutting surface.

In yet another aspect of the present invention, the invention is directed towards a cutting surface that is comprised of any of the shapes or designs mentioned above and cutting surfaces provided by any of the means mentioned in above that can contain alternating or other sequences of an enabling feature and a cutting features (e.g. an adhesive or tacky area or areas in a pattern (alternating or otherwise) with embedded cutting protrusions or other cutting features disposed thereon). Likewise the shape can be comprised of compositions that combine materials to achieve the desired conformability and other performance features (e.g. cost) via for example a core of a less expensive material like a rubber or plastic foam or paper or straw shreddings with a surface comprised of the desired cutting features, with or without the application of any solutions mentioned above.

It is to be understood that the aspects and objects of the present invention described above may be combinable and that other advantages and aspects of the present invention will become apparent to those having ordinary skill in the art upon reading the following description of the drawing and the detailed description thereof.

BRIEF DESCRIPTION OF THE DRAWINGS

The present invention will become more fully apparent from the following description and appended claims, taken in conjunction with the accompanying drawings. Understanding that the accompanying drawings depicts only typical embodiments, and is, therefore, not to be considered to be limiting of the scope of the present disclosure, the embodiments will be described and explained with specificity and detail in reference to the accompanying drawings as provided below.

DETAILED DESCRIPTION

Figures 1A, 1B, 1C:
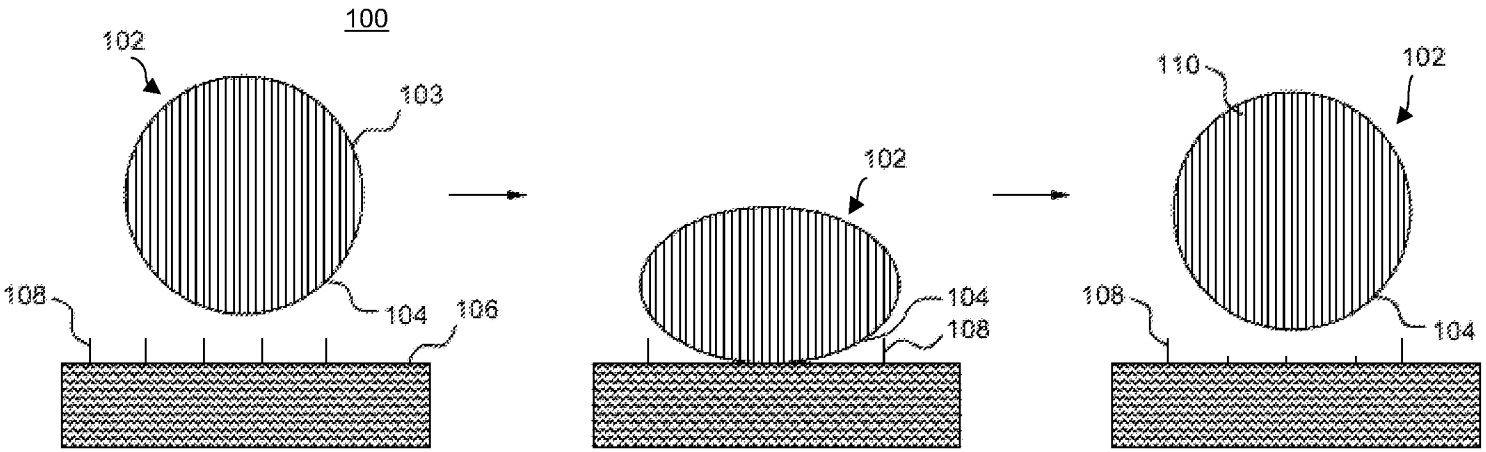
FIGS. 1A-1C depict a cross sectional view cutting apparatus in accordance with an embodiment of the present invention.

For purposes of this disclosure, fiber will be used to describe all cutable, non-hair filamentous protrusions to which this device and cutting surface will apply.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Reference throughout this description to features, advantages, objects or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, any discussion of the features and advantages, and similar language, throughout this specification may, but does not necessarily, refer to the same embodiment.

FIGS. 1A-1C depict a cutting apparatus 100 in accordance with an embodiment of the present invention. As illustrated, a compliant roller 102 is shown in cross section as a cutting surface 104 prepares to engage (FIG. 1A), engages (FIG. 1B) and moves away from (FIG. 1C) a hair- or fiber-bearing surface 106 including filamentous protrusions 108. The cutting surface 104 of the roller 102 is formed at a peripheral surface 103 can be comprised of compliant fabrics, bundles, spheres, rollers (rigid and conformable), that can be moved, rubbed, squeezed or rolled over an irregular surface with folds, convolutions, crevices, orifices, etc. The cutting surface may include a bundle of one or more sharp edged ribbons, wires, threads, or biomass elements, such as leaves, grasses or hair, or other segments or pieces of the same material being cut.

The peripheral surface 103 of a compliant roller 102 may be formed from natural or synthetic foam or sponge or flexible metallic or non-metallic materials, including but not limited to polymers, elastomers, rubbers or composites formed in any effective bundle or network or cut to any effective pattern of grooves, slots, or other cutting designs. In some embodiments, the body 110 and the outer peripheral surface 103 may be formed from the same compliant or rigid material. In other embodiments, the body 110 and peripheral surface 103 are formed from different materials and may be combinations of compliant and rigid materials with various degrees of compliance and rigidity. Some suitable rigid materials including but not limited to metals, ceramics, polymers, and composites formed as a uniform solid or a hollow solid.

The deformation of the roller 102 depicted in FIG. 1B is representative of the engagement of a cutting surface 104 that is compliant with the hair- or fiber-bearing surface 106 and emphasizes that the roller 102 can be compliant to conform to the hair- or fiber-bearing surface 106. This may be beneficial for a cutting surface 104 that entangles the hair or fiber (i.e., filamentous protrusions 108) into an entangled surface or pattern of cutting edges to effect cutting (to be described). If the cutting surface 104 is more rigid it can roll to achieve compliancy to irregular surfaces without as much deformation in the cutting process. The hair- or fiber-bearing surface 106 can be irregular and contain folds, convolutions and small crevices but is depicted in the figures as a flat region for ease of illustration only and is not limited to this depiction.

Figures 2A, 2B, 2C:
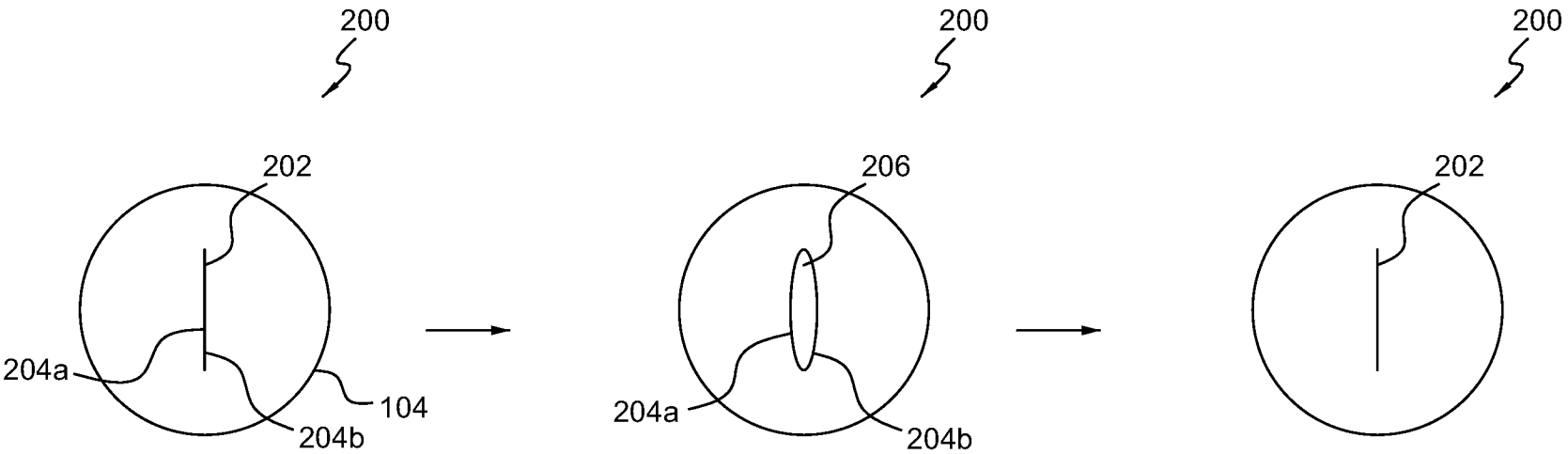
FIGS. 2A-2C depict a cutting feature of a cutting apparatus in accordance with an embodiment of the present invention.

FIGS. 2A-2C depict a portion of a cutting surface 104 immediately surrounding a cutting feature 200 of a cutting apparatus 100 in accordance with an embodiment of the present invention. As illustrated, cutting edge surfaces 204*a*, 204*b* form opposing sides of a sharp-edged aperture, slit 202 in a normally closed configuration, or other close surfaced structure is formed into the material of a cutting surface 104 with sharp, fiber or hair cutting edge surfaces 204*a*, 204*b* on opposing sides of the slit 202.

Upon pressure on the cutting surface 104, with or without deformation, or movement of the cutting surface 104 with respect to the hair- or fiber-bearing surface, the aperture or slit 202 changes shape from normally closed configuration to an open configuration to receive one or more hairs or fibers. A change in the pressure condition, or movement of the cutting surface 104 with respect to the hair- or fiber-bearing surface, causes the aperture or slit 202 to change shape to a closed configuration, bringing cutting surfaces 204*a*, 204*b* into contact with one or more hairs or fibers, severing the fibers or hairs.

In an embodiment, the slit 202 is a normally opened sharp-edged aperture formed by opposing cutting edge surfaces 204*a*, 204*b*. Upon pressure on the cutting surface 104, with or without deformation, the aperture or slit 202 changes shape from a normally open configuration to a closed configuration, bringing cutting surfaces 204*a*, 204*b* into contact with one or more hairs or fibers, severing the fibers or hairs. A change in the pressure condition, or movement of the cutting surface 104 with respect to the hair- or fiber-bearing surface, causes the aperture or slit 202 to change shape to its normally open configuration.

Accordingly, in either the normally closed configuration or the normally open configuration, a change in shape of the aperture or slit 202 from an open configuration to a closed configuration effects a cutting or hair or fibers received in the aperture.

The edge surfaces 2014*a*, 204*b* are illustrated as smooth surfaces for ease of illustration only. The slit 202 may be formed to have a series of peaks and valleys resembling a series of saw teeth, or other effective cutting pattern. The cutting surfaces 204*a*, 204*b* could also be the result of entangled sharp edged plant leaves, ribbons, wires, metals or metallized or otherwise treated plastics or natural materials or fibers such as spider silk.

As a portion of the cutting surface 204 of the roller 102 is deformed and conforms to the hair- or fiber-bearing surface 106 (FIGS. 1A-1C), the slit 202 opens forming an aperture 206 as depicted in FIG. 2B (depicted as an oval but not restricted to this opening shape) enabling the cutting surface 104 to entangle, entrap or otherwise engage with the filamentous protrusions 108. On release of the pressure (FIG. 1C) the deformed portion of the roller reforms and returns to the undeformed condition. In doing so, the slit 202 returns to its normally closed configuration (FIG. 2C) enabling the severing the fiber or hair (filamentous protrusions 108) as depicted in FIG. 2C.

Figure 3C:
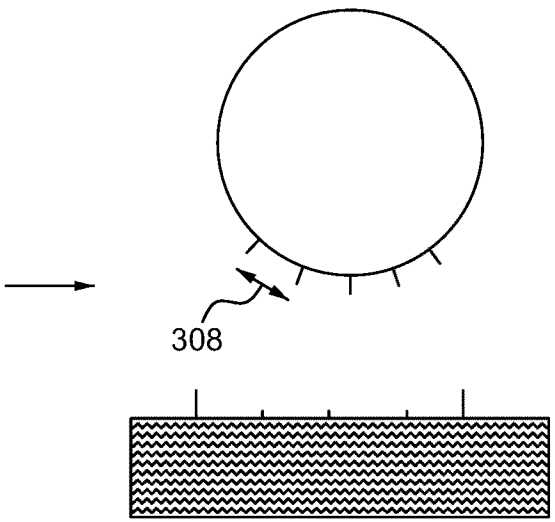
FIGS. 3A-3C depict a cutting feature of a cutting apparatus in accordance with an embodiment of the present invention.
Figure 3B:
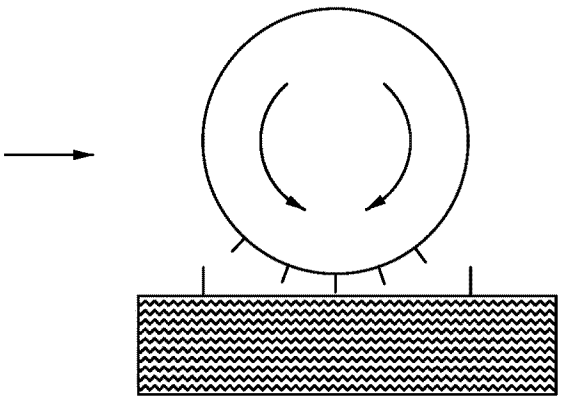
Figure 3A:
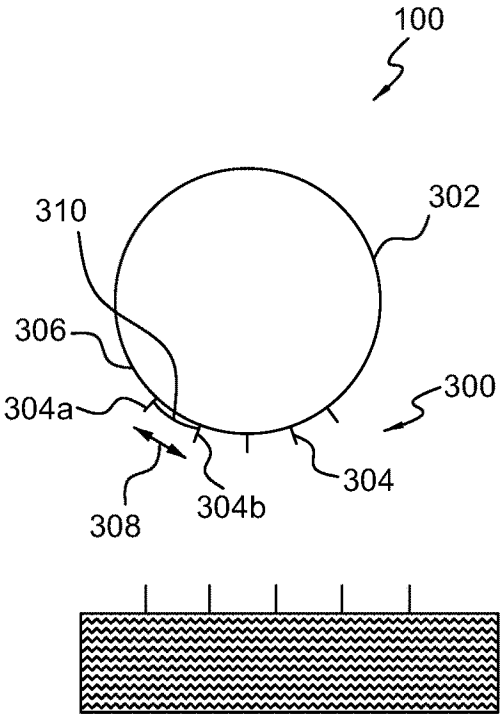

FIGS. 3A-3C depict a cutting feature 300 of a cutting apparatus 100 in accordance with an embodiment of the present inventions. The cutting feature 300 may be used with a compliant roller 102 (FIGS. 1A-1C) or a rigid roller 302 as illustrated in FIGS. 3A-3C. The cutting feature 300 includes a plurality of cutting edges 304 protruding from the outer peripheral surface 306 of the roller 302. The cutting edges 304 may be formed in a non-limiting example by partially embedded blades in the outer peripheral surface 306. Other protruding cutters or elements could also be partially disposed in the roller 302 or on the peripheral surface 306.

As depicted in FIGS. 3A-3C, the cutting edges 304 may be disposed on the outer peripheral surface 306 circumferentially spaced apart by a gap 308. In an embodiment, a portion of the circumferential surface 306 between adjacent cutting edges, for example 304*a* and 304*b*, may include a surface configured to facilitate the cutting effected by the cutting edges 304. In a non-limiting example, the surface between the adjacent cutting edges may include a tacky surface or treatment to grab and raise the hair or fiber to ready it for cutting.

Figure 4:
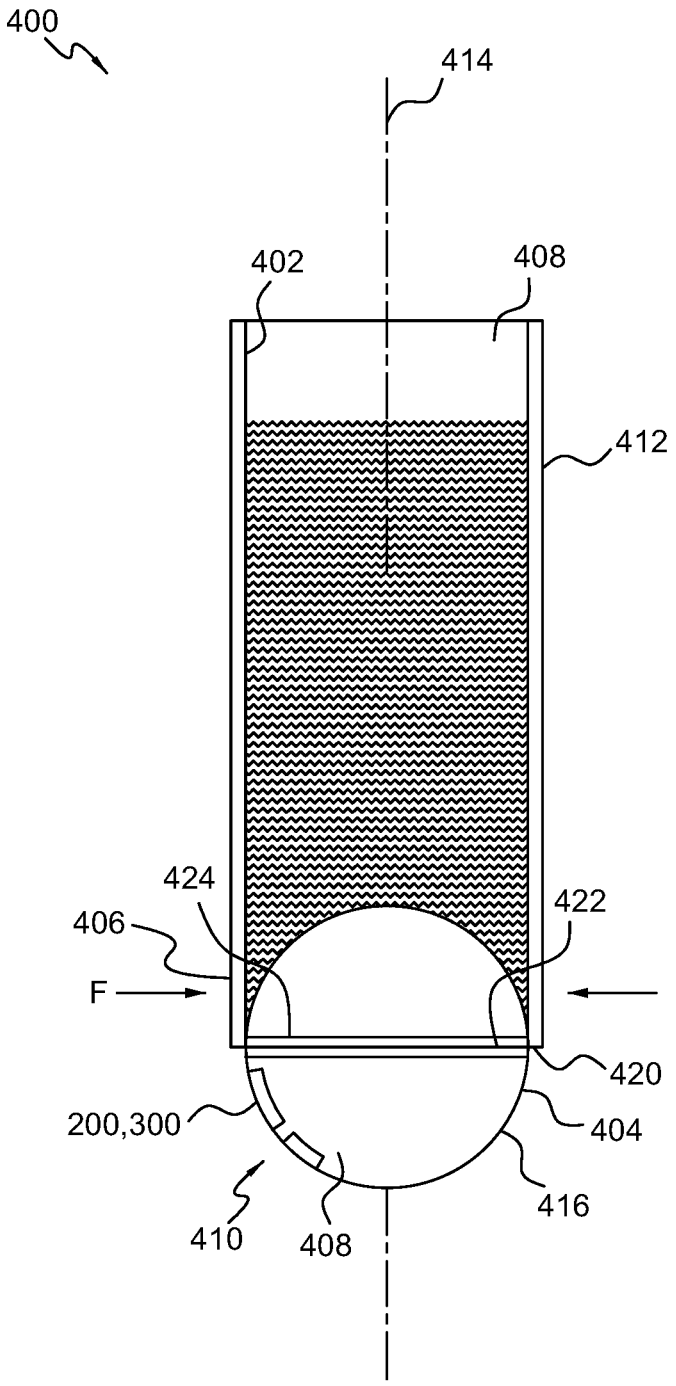
FIG. 4 depicts a cutting device in accordance with an embodiment of the present invention.

FIG. 4 depicts a cutting device 400 in accordance with an embodiment of the present invention in a side sectional view. As illustrated, a spherical roller 404 is supported at a first end 406 of support member 402. In an embodiment, the spherical roller 404 is supported at the first end 406 for free rotation. As used herein, "free rotation" is used to mean the spherical roller 404 does not have a fixed axis of rotation, similar to the ball in a ball point pen type of construction, where rotation of the ball is not controlled by a fixed axis, but by the direction of travel of the pen body (here support member 402) while the ball is in contact with a fixed surface.

In an embodiment, the spherical roller 404 is supported at the first end 406 for rotation about a fixed axis, for example an axle 422 disposed in a diametrical passage 424 formed through the spherical roller 404. The ends of the axle 422 may be received in receptacles (not shown) formed at the first end 406. Alternately, outwardly directed and diametrically opposed projections (not shown) may be formed on the outer peripheral surface 416 and received in receptacles (not shown) to support the spherical roller 404 for rotation about an axis.

In an embodiment, rotation of the spherical roller 404, either free or about a fixed axis, can be controllably limited or prevented by, for example by an inwardly directed force F applied to the support member 402 generally at the first end 406. The force may increase a pressure exerted on the cutting apparatus 410 to slow or stop rotation. Enhanced cutting of hair or fiber may be realized by slowing or stopping the rotation as the cutting apparatus 410 while moving the cutting apparatus 410 along a hair- or fiber-bearing surface 106.

The spherical roller 404 includes an outer peripheral surface 416 that may be compliant or rigid. In embodiments including a compliant surface, at least the outer peripheral surface 416 may be formed from any of the compliant materials discussed above. In some embodiments, the body 418 of the roller 404 is rigid and may be formed from any suitable rigid material discussed above.

The spherical roller 404 may include any of the cutting features 200 (FIG. 2) or the cutting features 300 (FIG. 3), singly or in any combination, discussed above to form cutting apparatus 410. Cutting features 200, 300 are schematically shown in FIG. 4 at the outer peripheral surface 416 in a non-limiting embodiment. Any number of cutting features 200, 300 may be used in any design or repeating or non-repeating pattern.

In the embodiment illustrated, an inner wall of the support member 402 provides a boundary for a reservoir 408, the reservoir 408 in communication, for example fluid communication, with the spherical roller 404. The reservoir 408 may be configured to contain a solid, liquid or vapor material provided to enhance cutting. Materials in the reservoir could contain but not be limited to enzymes such as peptidases, thioglycolates, or other materials to enhance cutting or removal of hair, surface finishes such as dyes, sizes, bleaches, tanning agents, sunscreen, etc. to enhance the hair- or fiber-bearing surfaces 106 as the fiber is trimmed, adhesives to enhance removal of the cut hair or fiber, as pretreatments, post treatments or treatments during cutting of the hair, fiber, or filamentous protrusions 108 (FIG. 1).

The reservoir 408 may also contain heated or cooled fluids to enhance cutting or comfort. Such fluids can include, water, ice, or other materials that can be heated either as the entire cutting device 400 or via removal of the support member 402 for separate heating and reinsertion after heating. A typical method for heating could be putting the cutting device 400 in a microwave provided the cutting apparatus 410 was of a microwavable material or providing heating via another energy source suitable for the material of the cutting device 400. Radiant heating or chemical means of heating may also be applied to the material held in the reservoir 408 to enhance cutting and/or comfort and experience.

The reservoir 408 may be configured to remove the cut hair or fiber (filamentous protrusions 108) from the cutting apparatus 410 once separated from the hair- or fiber-bearing surface 106.

The support member 402 may include a casing 412 disposed on an outer surface thereof. The casing may be displaceable along an axis 414 of the support member 402, for example by sliding on the outer surface. The support member 402, including the cutting apparatus 410 and the reservoir 408 may be removable from the casing 412 to facilitate refilling, cleaning, recycling and/or disposal.

In some embodiments, the casing 412 enables positioning the cutting apparatus 410 from the hair- or fiber-bearing surface (106, FIG. 1) to adjust the depth of cutting. The first end 406 of the support member 402 may include a circular opening with a cutting edge or bar 420 that the cutting apparatus 410 comes in cutting contact with as the spherical roller 404 or the cutting apparatus 410 rotates within the support member 402. The cutting bar 420 cooperates with the spherical roller 404 and enables cuttings between the cutting apparatus 410 and the cutting edge at first end 406. The first end 406 is dimensioned to facilitate cutting bars 420 to be placed or formed around the circumference in closest contact with the spherical roller 404.

Cutting device 400, especially those with a support element 402 that is replaceable and easy to insert in the casing 412 (as for example a snap in or otherwise easy insert fit to the casing 412), could contain non cutting surface spheres for treating the pre-cut fiber or hair surface either before or after cutting by rolling application of the material held in the reservoir 408. In these cases the spheres (similar to 404) could be designed for application of a material as for example via a compliant foam or sponge material. The dimensions of the cutting device 400 can be varied to fit tight crevices such as, for hair cutting in the ears and nose. A set of different sizes could be provided to cover broader and narrower surfaces, openings, crevices for both hair cutting and fiber removal from hair or fiber-bearing surfaces.

Figure 5B:
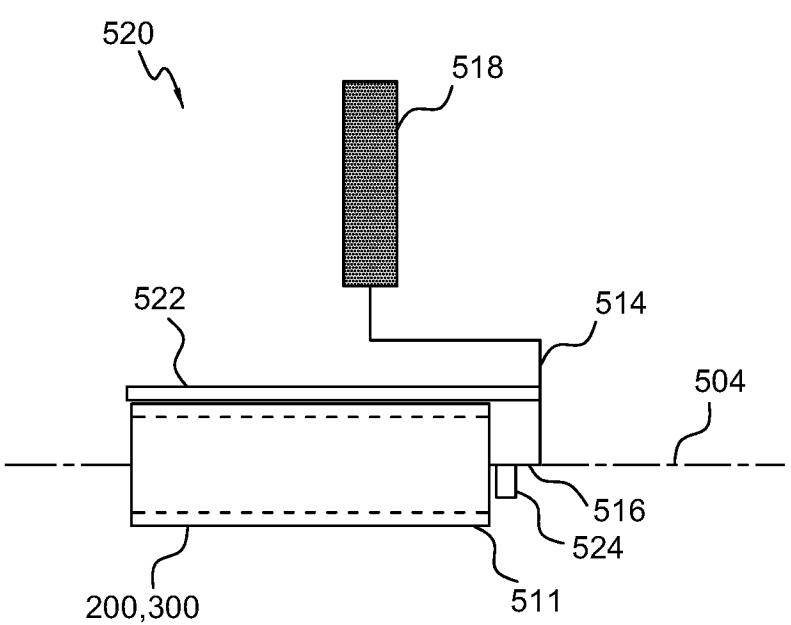
FIG. 5B depicts a plan view of a cutting device in accordance with an embodiment of the present invention.
Figure 5A:
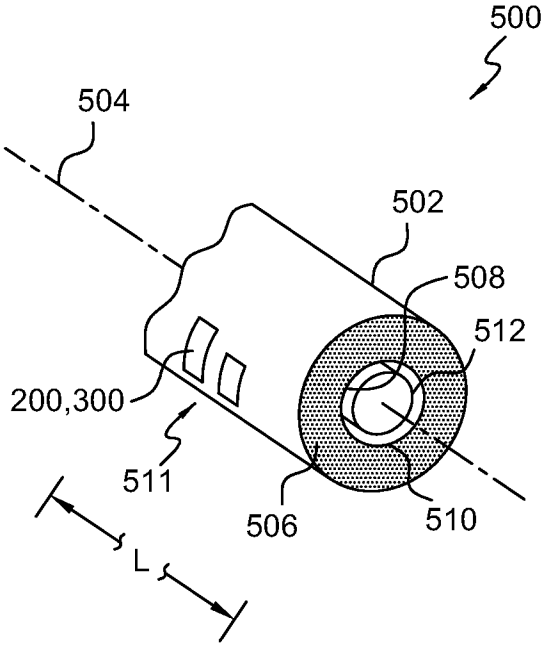
FIG. 5A depicts a partial perspective end view of a cutting apparatus in accordance with an embodiment of the present invention.

FIG. 5A depicts a cylindrical roller 500 in a partial perspective end view. The body 506 of the cylindrical roller 500 has a longitudinal axis 504 and a circular cross section bounded by outer peripheral surface 502. In an embodiment, the cylindrical roller 500 includes an inner surface 508 bounding a cavity 510 that extends along at least a portion of a length L of the body 506.

The body 506 may be formed from a porous material adapted for fluid transport at least from the inner surface 508 to the outer peripheral surface 502. In embodiments not including a cavity 510, the body may be formed from a porous material and adapted to transport a fluid from an interior portion proximate the longitudinal axis to the outer peripheral surface 502.

In some embodiments, a portion of the cavity 510 is sized to removably accept a reservoir 512. The reservoir 512 is configured for yielding a fluid contained therein in a controlled fashion to the inner surface 508 to the porous body.

A suitably formed body 506, for example a porous body, transports the yielded fluid to the outer peripheral surface 502.

The outer peripheral surface 502 of cylindrical roller 500 may be a compliant surface as described above or a rigid surface. Compliant surfaces may be formed from the materials discussed above or other suitably compliant materials. Rigid surfaces may be formed from the suitable materials discussed above. In some embodiments, the outer peripheral surface 502 and the body 506 are formed from the same compliant or rigid material. In other embodiments, the outer peripheral surface 502 and the body 506 are formed from different materials, and may include one or more materials with various degrees of compliance and rigidity.

Any of the cutting features 200, 300 discussed above, singly or in any combination, may be disposed at the outer peripheral surface 502 of the cylindrical roller 500 to form a cutting apparatus 511. The cutting features 200, 300 are illustrated schematically in FIG. 5A disposed at the outer peripheral surface 502. Any number of cutting features 200, 300 may be used in any design or repeating or non-repeating pattern.

Cutting apparatus 511 is constructed to effect cutting hair or fiber from a hair- or fiber-bearing surface. The cylindrical roller 500 can have a surface comprised of any of the cutting surfaces described above including entanglements of sharp edged wires, plant leaves, ribbons; surface cut apertures in a thin metal or other material covering to produce sharp cutting edges that open with pressure, or sharp cutting edges cut into the same surface without the need for opening to engage the hair or fiber.

The cutting apparatus 511 may be supported for rotation about longitudinal axis 504 at a first end 516 of a support member 514 to comprise a cutting device 520. The support member 514 may include a gripping portion or handle 518 for controlling the movement of the cutting device 520.

As the cutting device 520 is brought into contact with a hair- or fiber-bearing surface (for example surface 106 in FIG. 1) and the cylindrical roller 500 caused to roll on the surface by movement between the support member 520 and the hair- or fiber-bearing surface, cutting or the hair or fiber can be effected as the cutting features 200, 300 engage and sever the hair or fiber. The cutting features 200, 300 are illustrated schematically in FIG. 5B as dashed lines.

In some embodiments a braking device or mechanism 524 may be provided to selectively slow or prevent rotation of the cutting apparatus 511 about the axis 504 to enhance cutting as discussed above.

In some embodiments, the cutting features 200, 300 can operate with a cutting bar 522 that the cutting apparatus 511 comes in cutting contact with as the cutting apparatus 511 rotates about longitudinal axis 504. The cutting bar 522 cooperates with the cylindrical roller 500 and causes filamentous projections 108, including hair and fibers, to be trapped between the cutting apparatus 511 and an edge of the cutting bar 522 and severed from the hair- or fiber-bearing surface 106. The cutting bar 522 is dimensioned and adjustably positioned at a first end 516 of the support member 514 proximate to the cutting apparatus 511 in closest cutting contact with the cylindrical roller 500.

The cylindrical roller 500 could be metallized or otherwise rendered sharp and cutting as the edges of an open foam that may have either a rigid or compliant core. The cylindrical roller 500 provide compliant cutting with either a compliant or rigid roller in contact with a hair- or fiber-bearing surface 106 by rolling along irregular or convoluted areas and following the folds, crevices and orifices. The cylindrical roller 500 can be dimensioned to reach small and hard to get places or large to cover broad areas in much the same way as rollers that are used to apply paints to tight corners using small rollers and to large surfaces using wider rollers. A reservoir 512 may be provided for material that can enhance the cutting performance by pre, post or simultaneous treatments with cutting. The reservoir 512 can be removable from the cylindrical roller 500 to be refilled, recycled or disposed of as an insert and/or combined with the cylindrical roller 500 to be recycled, refilled or otherwise disposed of as a unit. A non-cutting outer roller may also be available as a snap on to enable pre or post treatments without cutting in similar fashion as described for the cutting device 400 in FIG. 4. Materials to be held and yielded by the reservoir 512 include but are not limited to those listed for the cutting device 400 including fluids such as water that may be heated either in the cutting device or via easy removal for filling, heating and reinsertion.

Figure 6A:
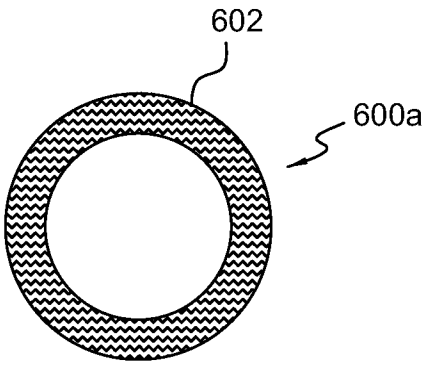
FIGS. 6A and 6D depict cross sectional views of cutting apparatus in accordance with embodiments of the present invention.
Figure 6B:
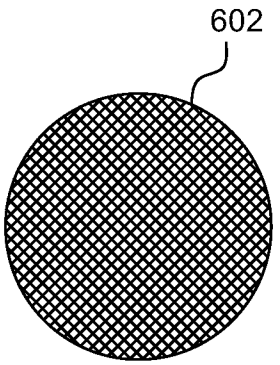
FIGS. 6B, 6C, 6E, and 6F depict surfaces of cutting apparatus in accordance with embodiments of the present invention.
Figure 6C:
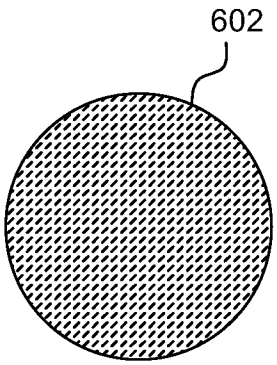
Figure 6D:
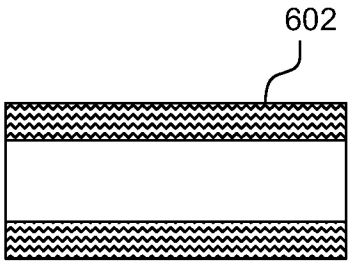

FIGS. 6A and 6D depict cross sectional views of cutting apparatus in accordance with embodiments of the present invention for both spherical cutting apparatus 410 (FIG. 6A) and cylindrical cutting apparatus 511 (FIG. 6D). FIGS. 6A and 6D depict core and shell concepts in which the outer peripheral surface 602 of the sphere 600*a* or cylinder 600*b* is the cutting surface and the core is a material to provide compliancy such as, but not limited to a foam or rubber and/or lower cost such in a core of paper shreds or straw. In the case of the cylindrical roller cutting device the reservoir 512 (FIG. 5) may serve as a compliant core and may include a foam or sponge as the inner core material to also include a material such as a fluid to enhance cutting in a pre, post or simultaneous treatment. The sponge core would be filled in the same way as an empty inner tube reservoir.

Figure 6E:
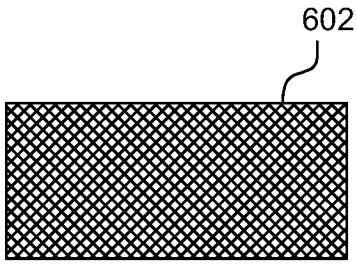
Figure 6F:
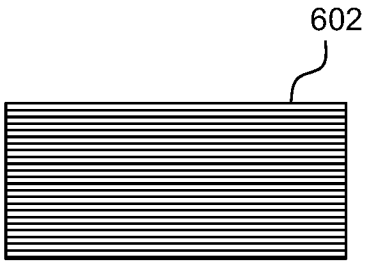

FIGS. 6B and 6C, depict the outer surfaces of exemplary spherical cutting apparatus 410. FIGS. 6E, and 6F depict the outer surfaces of exemplary cylindrical cutting apparatus 511. The outer surface can be any of the described cutting surfaces discussed above in any combination of sizes and patterns for the compliant or rigid sphere or as cylindrical cutting blades in any spacing or pattern that may operate in combination with a cutting bar 522.

FIGS. 6B/6C and 6E/6F depict cutting apparatus having solid core spherical roller and cylindrical roller, respectively. The solid core may provide a compliant or rigid outer peripheral surface 602.

The invention also includes the appropriate peripheral areas to enhance the attractiveness of the cutter configurations including the support members 402 and 514 as well as spherical cutting apparatus that may be comfortable to operate by themselves. This includes attractive printing, graphics, colors, textures for the cylindrical cutting device 520, the tubular cutting device 400 and for a compliant soft sphere or easily rolled harder sphere itself. In addition, the invention also comprises new technologies such as mobile enabled interactive codes such as but not limited to 2D QR and other codes and interactive electronics such as NFC (Near Field Communication) and RFID (Radio Frequency Identification) to enhance the experience and the information provided to the consumer including but not limited to the description of how the cutter is to be safely used and the advantages of the cutters vs. competitive offerings. The invention also comprises ways that a fluid in one of the reservoirs (408, 512) can be heated including radiant heat, microwave heat, induction coupled power and heat, Wi-Fi coupled power and heat and/or other means either connected, coupled, or inductively delivered. The invention likewise comprises comprehensive ways to clean, reuse, recycle and/or otherwise safely dispose of the cutting devices.

For the above examples of suitable materials, technologies, or properties, are merely illustrative and are not intended to be limiting to only those materials, technologies or properties listed above.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

What is claimed is:

1. A cutting apparatus comprising:

a roller; and a plurality of cutting features disposed in a peripheral surface of the roller, the cutting features comprising opposing cutting edge surfaces forming a sharp-edged aperture in the peripheral surface of the roller, wherein when the roller rotates in contact with a filamentous surface the plurality of cutting features are configured to cut filamentous protrusions on the filamentous surface, and wherein the sharp-edged aperture is a normally closed slit which is configured to open from a normally closed configuration when a pressure is applied to a portion of the roller to deform the roller to conform to the filamentous surface and return to the normally closed configuration when the portion of the roller returns to an undeformed condition.

2. The apparatus of claim 1, wherein the cutter has a circular cross section.

3. The apparatus of claim 2, wherein the roller is rigid.

4. The apparatus of claim 1, wherein the outer peripheral surface is compliant for conforming to the filamentous surface.

5. The apparatus of claim 1, wherein the open slit engages a filamentous protrusion and severs the filamentous protrusion when returned to the normally closed configuration.

6. The apparatus of claim 1, wherein the cutting features comprise cutting edges protruding from the outer peripheral surface.

7. The apparatus of claim 6, wherein the outer peripheral surface includes a treatment to facilitate cutting.

8. A cutting device comprising:

a support member; and a cutting apparatus comprising:

a roller;

a plurality of cutting features disposed in a peripheral surface of the roller, the cutting features comprising opposing cutting edge surfaces forming a sharp-edged aperture in the peripheral surface of the roller; and a cutting bar at a first end of the support member in contact with the cutting apparatus, wherein when the roller rotates in contact with a filamentous surface the plurality of cutting features are configured to cut filamentous protrusions on the filamentous surface, wherein the sharp-edged aperture is a normally closed slit which is configured to open from a normally closed configuration when a pressure is applied to a portion of the roller to deform the roller to conform to the filamentous surface and return to the normally closed configuration when the portion of the roller returns to an undeformed condition, and wherein the support member supports the cutting apparatus for rotation.

9. The device of claim 8, wherein the roller is a sphere supported for free rotation at a first end of the support member.

10. The device of claim 9, wherein the support member includes a reservoir in communication with the cutting apparatus.

11. The device of claim 10, wherein the reservoir removes cuttings from the cutting apparatus.

12. The device of claim 9, further comprising a casing disposed on an outer surface of the support member and displaceable along an axis of the support member.

13. A cutting device comprising:

a roller; and a plurality of cutting features disposed in a peripheral surface of the roller, the cutting features comprising opposing cutting edge surfaces forming a sharp-edged aperture in the peripheral surface of the roller, wherein when the roller rotates in contact with a filamentous surface the plurality of cutting features are configured to cut filamentous protrusions on the filamentous, and whereby with the sharp-edged aperture in a normally closed configuration, the sharp-edged aperture comprises a slit which is configured to open when a pressure is applied to a portion of the roller to deform the roller to conform to the filamentous surface and return to the normally closed configuration when the portion of the roller returns to an undeformed condition.

14. The apparatus of claim 13, wherein the cutter has a circular cross section.

15. The apparatus of claim 14, wherein the roller is rigid.

16. The apparatus of claim 13, wherein the outer peripheral surface is compliant for conforming to the filamentous surface.

* * * * *